United States Patent [19]

DeMay et al.

[11] Patent Number: 5,060,451

[45] Date of Patent: Oct. 29, 1991

[54] CONVERTIBLE CARTON FILLING MACHINE

[75] Inventors: Karl F. DeMay, Newark; Darryl F. Lord, Port Gibson; Henry Talma, Phelps; Robert S. Conklin, Rochester, all of N.Y.

[73] Assignee: Fold-Pak Corporation, Newark, N.Y.

[21] Appl. No.: 617,213

[22] Filed: Nov. 23, 1990

[51] Int. Cl.[5] ..... B65B 59/00

[52] U.S. Cl. ..... 53/201; 53/284.5; 53/564; 493/476

[58] Field of Search ..... 53/201, 564, 284.5, 53/376.5, 376.4, 377.2, 377.4; 493/476, 475, 478, 316, 125, 130, 128, 137

[56] References Cited

U.S. PATENT DOCUMENTS

| | | | |
|---|---|---|---|
| 2,933,869 | 4/1960 | Meyer-Jagenberg | 53/201 |
| 3,282,021 | 11/1966 | Hartman | 53/201 |
| 3,462,914 | 8/1969 | Dorfmann | 53/201 |
| 3,593,493 | 7/1971 | Alduk | 53/201 |
| 4,565,048 | 1/1986 | Lade | 493/476 X |

*Primary Examiner*—James F. Coan
*Attorney, Agent, or Firm*—Cumpston & Shaw

[57] ABSTRACT

An ice cream carton filling machine includes a hopper for storing empty cartons; a filling spout for filling the empty cartons with ice cream; a conveyor means for moving the empty cartons from the hopper to the filling spout, and for moving the filled cartons away from the filling spout to a discharge end; an interchangeable carton closing mechanism mountable on the machine includes a removable bottom flap tucker disposable between the hopper means and the filling spout for closing one end of a lock end carton; a removable top flap tucker disposable between the filling spout and the discharge end for closing the top of a lock end carton; a top adhesive sealing and closing mechanism interchangeably disposable with said top flap tucker between the filling spout and the discharge end for closing the top end of a tamper evident glued end carton; a bottom adhesive sealing and closing mechanism interchangeably disposable with the bottom flap tucker between the hopper and the filling spout for closing the bottom end of a tamper evident glued end carton; and attachment fitting on said machine for interchangeably receiving said adhesive sealing mechanism and said flap tucker.

13 Claims, 18 Drawing Sheets

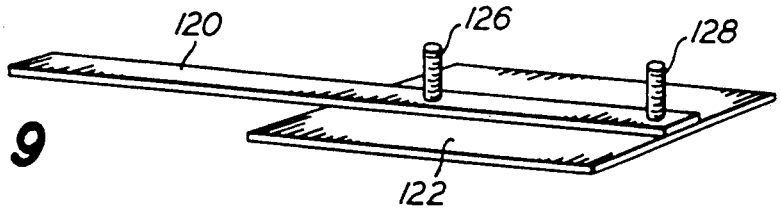
FIG. 9
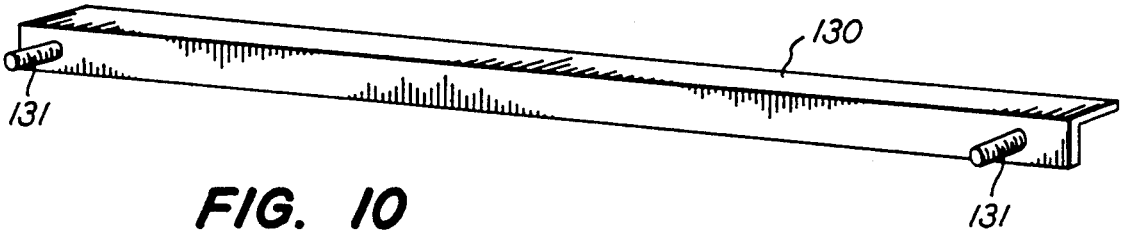
FIG. 10
FIG. 11
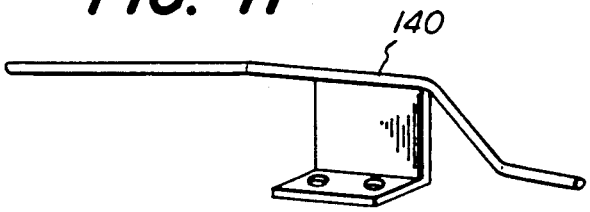
FIG. 12
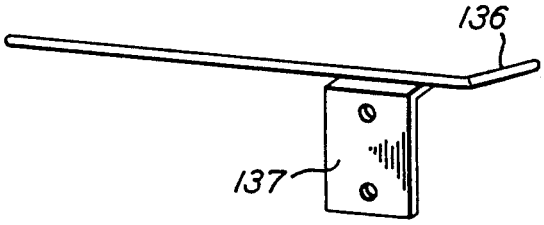
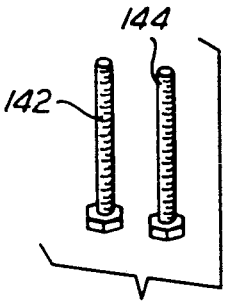
FIG. 13
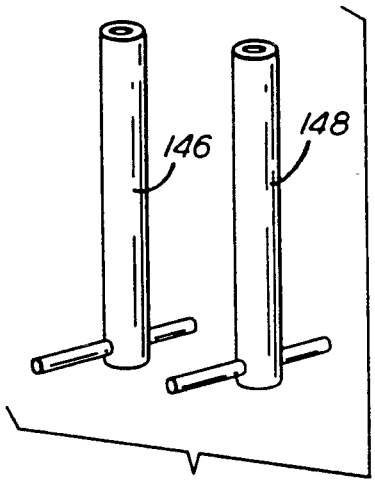
FIG. 14

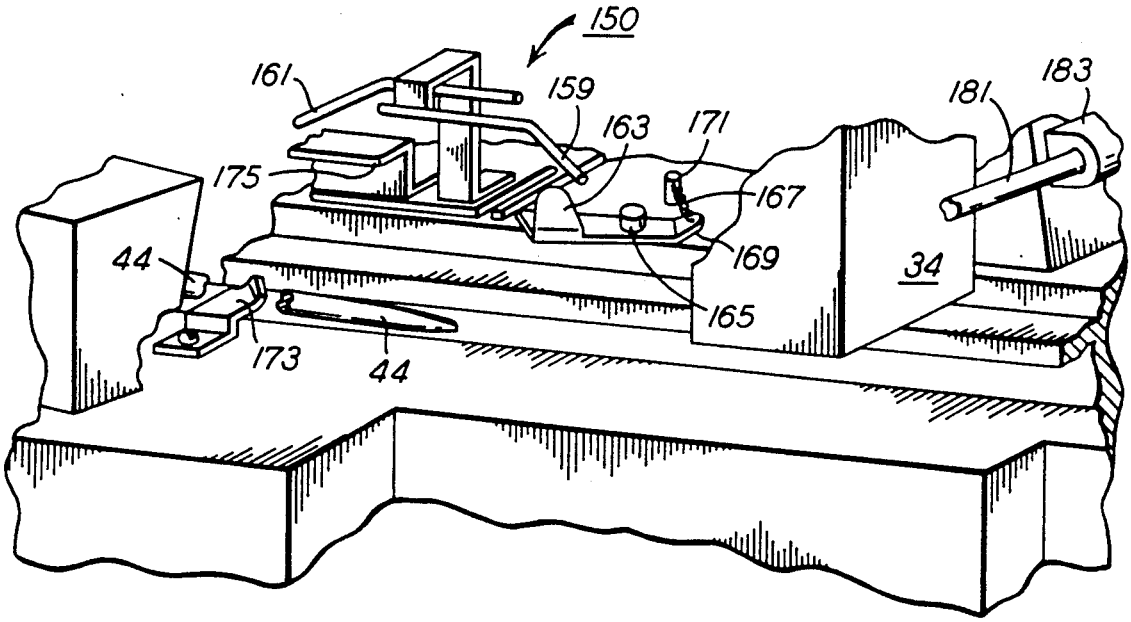
FIG. 15
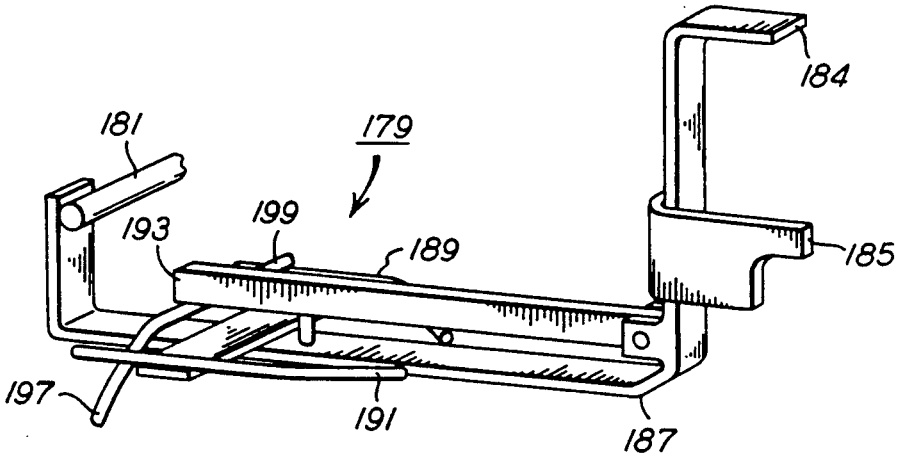
FIG. 16
FIG. 17
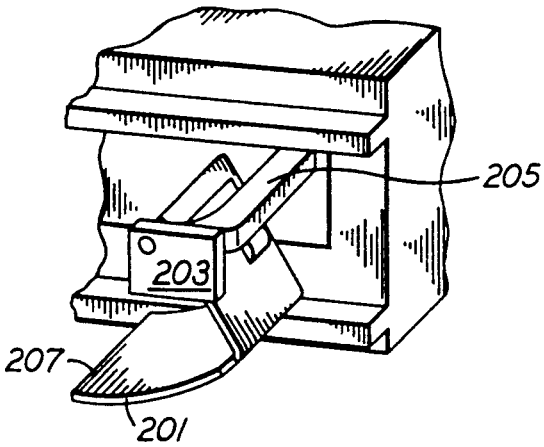

CONVERTIBLE CARTON FILLING MACHINE

This invention relates generally to apparatus for filling containers, and more particularly to a convertible ice cream carton filling machine for selectively filling two different heretofore incompatible ice cream cartons.

Machines for automatically filling ice cream cartons from a continuous flow of semi-fluid ice cream dispensed through a downwardly opening nozzle are known in the art. Various aspects of such machines are described, for example, in U.S. Pat. Nos. 2,612,016, 3,172,435, 3,298,288, 3,364,651, and 3,418,893.

In general, flattened carton blanks are stored in a magazine or hopper of the filling machine. They are removed one at a time by feeding apparatus, and opened in preparation for subsequent filling of the cartons. Typically, ice cream carton filling machines automatically move the cartons through several stations and use a reciprocal transfer mechanism to advance the cartons through a first zone, past at least one station, such as a container set up station, at which the bottom end of the erected carton is closed; and to a filling station at which the ice cream is continuously dispensed into successive cartons from a nozzle. The containers to be filled are normally advanced to the filling station below the nozzle at a level such that the tops of the containers are spaced slightly below the nozzle to allow the next to be filled carton to pass under the nozzle. The carton is then elevated into overlapping engagement with the lower end of the nozzle at the filling station and is moved downwardly by the weight of the ice cream as it is filled. When the top of the container drops below the lower end of the nozzle, the filled container is moved crosswise of the nozzle to shear the stream of material flowing from the nozzle from the material in the container as the next empty container moves into place. With this arrangement, the filled container, as it is moved away from the filling station, is at a level slightly above the level at which the incoming empty containers are advanced to the filling station. The filled containers are then moved through a second zone past at least a second station for closing the upper end of the carton; and thence to a discharge end where the filled cartons are discharged from the machine.

While there are at present a number of different types of ice cream cartons in use, for many years the most widely used carton by far was the lock end carton, having four body panels or walls hingedly articulated together along corner fold lines. Four flaps are provided at each of the upper and lower ends of the carton and connected to their respective walls along crease or fold lines. Typically, the first down and second down flaps close off the carton, and the third down and fourth down flaps are provided with an interengaging slot and hook for locking the carton ends. Apparatus for folding in the flaps in the appropriate order and tucking the hooked end into the slot is known, and per se forms no part of the present invention.

Recently, tamper evident glued end cartons have become available. They are preferred by the industry for a number of reasons. With the availability of such glued end cartons, new machines have been developed for dispensing, opening, filling and sealing such cartons. Typically, machines for filling glued end cartons use hot melt glue guns appropriately positioned and sequenced, with flap folding means for sequentially folding and gluing the ends of the carton.

Many ice cream plants, particularly small plants, have a substantial investment in one or more machines for filling lock end cartons. Often, the customers of such plants would prefer to purchase ice cream in glued end, tamper evident cartons, in addition to or as a substitute for lock end cartons. Typically, an ice cream filling machine costs $100,000 or more, and of replacing a lock end carton filling machine with a glued end carton filling machine is expensive. In addition, in many instances the volume of ice cream produced in a plant is too small to support two machines, and accordingly small plants are forced to choose which sort of carton they will produce, purchase the appropriate machine and produce that carton exclusively. This may cause some customers to take their business elsewhere, if the plant cannot provide the type of carton the customer wants.

Heretofore, no ice cream filling machine has been available that could be easily adapted to fill both lock end cartons and glued end cartons, as the need arose.

Accordingly, it is an object of this invention to provide a versatile ice cream carton filling machine comprising hopper means for storing a plurality of empty cartons; filling means for filling the empty cartons with ice cream; transport means for moving the empty cartons from the hopper means to the filling means, and for moving the filled cartons away from the filling means to a discharge; interchangeable carton closing means mountable on the machine comprising:

removable bottom flap tucking means disposable between the hopper means and the filling means for closing one end of a lock end carton;

removable top flap tucking means disposable between the filling means and the discharge for closing the top of a lock end carton;

top adhesive sealing and closing means interchangeably disposable with said top flap tucking means between the filling means and the discharge for closing the top end of a tamper evident glued end carton;

bottom adhesive sealing and closing means interchangeably disposable with the bottom flap tucking means between the hopper means and the filling means for closing the bottom end of a tamper evident glued end carton; and attachment means on said machine for interchangeably receiving said adhesive sealing means and said flap tucking means.

While the novel aspects of the invention are set forth with particularity in the appended claims, the invention itself together with further objects and advantages thereof may be better understood by referring to the following detailed description of a presently preferred embodiment of the invention, taken in conjunction with the accompanying drawings, in which:

FIGS. 9 through 14 are perspective views of the interchangeable components of an ice cream carton filling machine of this invention that are attached to the base shown in FIG. 1 to form a machine for filling a glued end carton;

FIG. 15 is a fragmentary perspective view of the components of the ice cream carton filling machine of the invention that immediately follow the ice cream spout, for closing the top end of a glued end ice cream carton;

FIG. 16 is an isolated perspective view of the upper flap guide and plough assembly that precedes the filling spout;

FIG. 17 is a perspective view of the lower flap tucker assembly of an ice cream carton filling machine in accordance with this invention;

Figure 21:
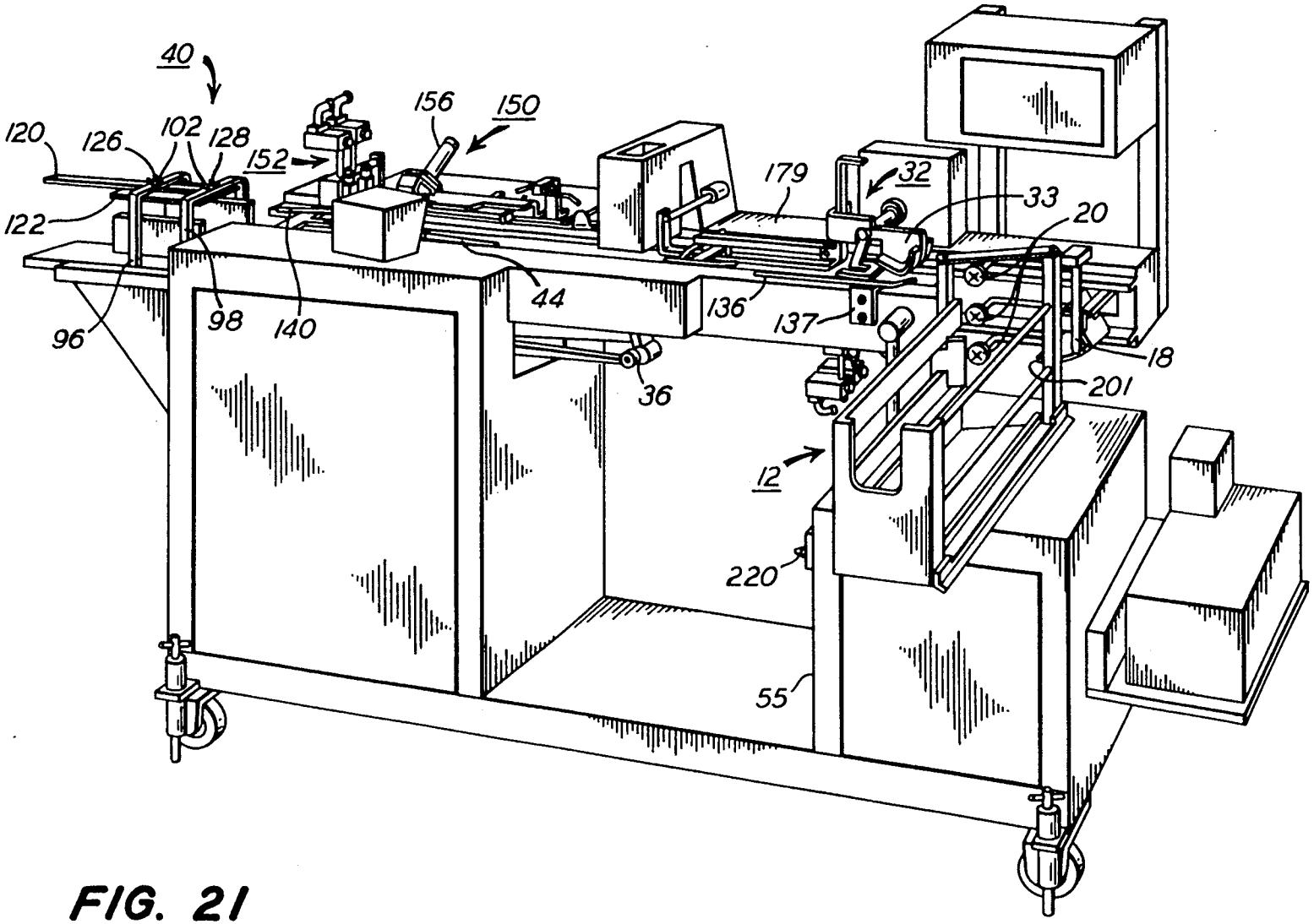
FIG. 21 is a perspective view of the ice cream filling machine of this invention, with the glued end carton components installed thereon for filling and sealing glued end cartons.

FIGS. 25 through 30 are perspective views showing a glued end ice cream carton in the various stages of assembly, showing the manner in which the ice cream carton filling machine of FIG. 21 closes the bottom of the carton; and FIGS. 31 through 48 are perspective view of a glued end ice cream carton in the various stages of assembly, showing the manner in which the ice cream carton filling machine of FIG. 21 closes the top end of the carton.

Figure 1:
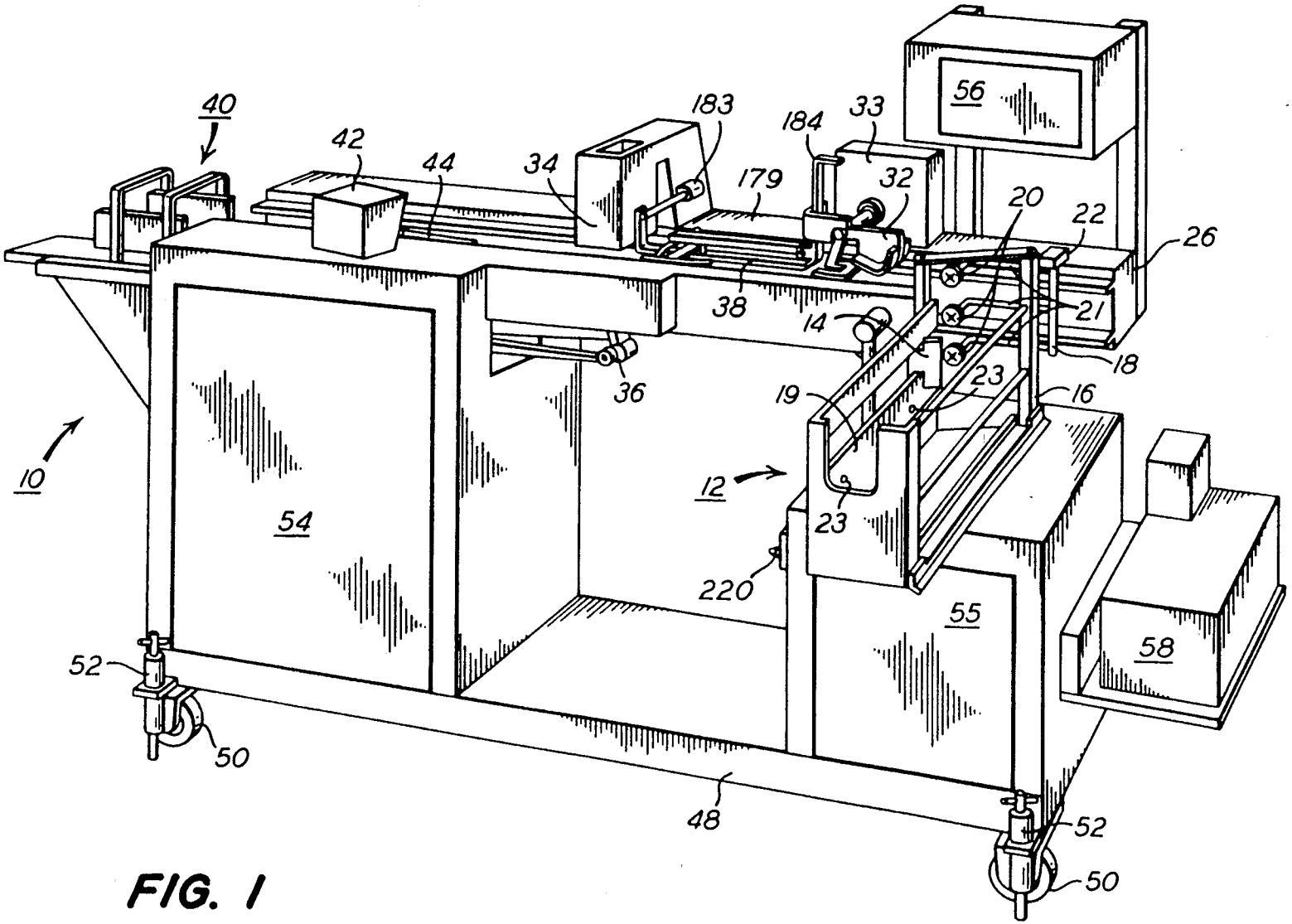
FIG. 1 is a perspective view of an ice cream carton filling machine base, in accordance with this invention, that may be adapted, by attaching one of two or more sets of interchangeable components, to fill either lock end cartons or glued end cartons.

FIG. 1 shows the platform or machine base 10 on which the two alternative configurations of an ice cream carton filling machine in accordance with this invention may be assembled. Preferably, the side plate 19 of hopper 12 has a pair of mounting holes 23 for attaching a removable guide rail 30 (see FIGS. 10 and 17) for accommodating the flattened glued end cartons. Conveniently, the machine base 10 may be constructed by stripping down and modifying a known lock end carton filling machine, such as the one sold by APV Anderson Corp. as a model 555 half gallon ice cream carton filler. Platform 10 incorporates the basic elements of the two presently preferred configurations of the convertible carton filling machine. The carton filling machine base shown in FIG. 1 includes a number of common elements for folding and tucking the various flaps of the lock end and glued end cartons that may be assembled with one of the two sets of interchangeable components installed thereon. The machine as shown in FIG. 1 will not close a carton, but rather is a platform upon which the two arrangements of the filling machine in accordance with the invention are assembled. Nevertheless, a number of the common elements are best seen in FIG. 1 and function in generally the same way in both of the configurations of the machine. An ice cream carton supply hopper 12 holds a multiplicity of flattened empty ice cream cartons (not shown) in position for sequential opening and filling. A spring or otherwise biased sliding push bar 14 urges the stack of empty cartons towards the feed end 16 of the hopper, where they are sequentially picked off, one at a time and opened by a vacuum picker 18 which has a plurality of soft rubber vacuum cups 20 mounted at the ends of three L-shaped arms 21 which in turn are mounted on and rotated by a pivotally mounted actuator 22 disposed at the beginning of an elongated two part conveyer 26.

Flap tucker 32 for folding down the leading flap of the carton as it traverses the conveyor is also modified as shown and discussed below. The tucker 32 is frequently referred to in the trade as a ding-dong, and is controlled by an actuator 33.

An ice cream filling nozzle 34 is shown in somewhat simplified form. A continuous supply of ice cream enters from a refrigerated supply system, and exits from the lower end of the nozzle 34 into the top of the ice cream carton. The carton is positioned in overlapping sleeve-like fashion with respect to the lower end of the nozzle, until a desired amount of ice cream has been injected into the carton, as determined, for example, by a weight sensitive balance mechanism of which a balance arm 36 is visible in FIG. 1. Between the ding-dong 32 and filler nozzle 34, an upper carton guide rail assembly 179 (see FIG. 16) holds the second and fourth down flaps of the carton open in preparation for insertion of the lower end of nozzle 34 into the top of the carton. In fact, the nozzle is not inserted into the carton, but the carton is moved upwardly with respect to the nozzle. The effect is the same.

After filling, the carton has moved down out of engagement from the nozzle and then moves from nozzle 34 to the left, as shown in FIG. 1, towards exit station 40, at which the box is squared off for delivery from the machine to further packaging equipment or the like. A tucker arm actuator 42 actuates a flap tucker 44 and is positioned between nozzle 34 and exit station 40 for closing the fourth down flap of the carton, as will be described in more detail below. Other components for closing the carton will be described in connection with the lock end and glued end configurations of the machine. The components of the machine base that close the bottom end of the carton are not visible in FIG. 1, and will be described in detail in connection with the description of the two configurations of the machine.

In addition to the carton handling components already described, the machine base 10 includes a generally standard platform 48 supported by castors 50, and levelling legs 52, one at each corner, for moving and setting up the machine in a desired location. A number of equipment cabinets 54, 55, and 56 enclose the various motors, controllers, and electronic processor components needed to operate and synchronize the machine. A hot glue supply assembly 58 is attached to the machine base to supply hot glue in the glued end configuration of the machine.

The ice cream carton filling machine base as thus far described is generally similar to a model 555 half-gallon ice cream filler manufactured by A. P. V. Anderson Brothers, Inc. of Rockford, Illinois. However, the model 555 is extensively modified to produce the filling machine base 10 described above, so as to accommodate both lock end cartons and glued end cartons. The 555 machine in its known form, cannot be used to fill and seal tamper evident hot melt glued end cartons of the type that the present invention is specifically designed to fill and seal. Prior to the present invention, even the manufacturer of the 555 machine believed that modification of the machine to fill glued end tamper evident cartons was impossible.

Figure 2:
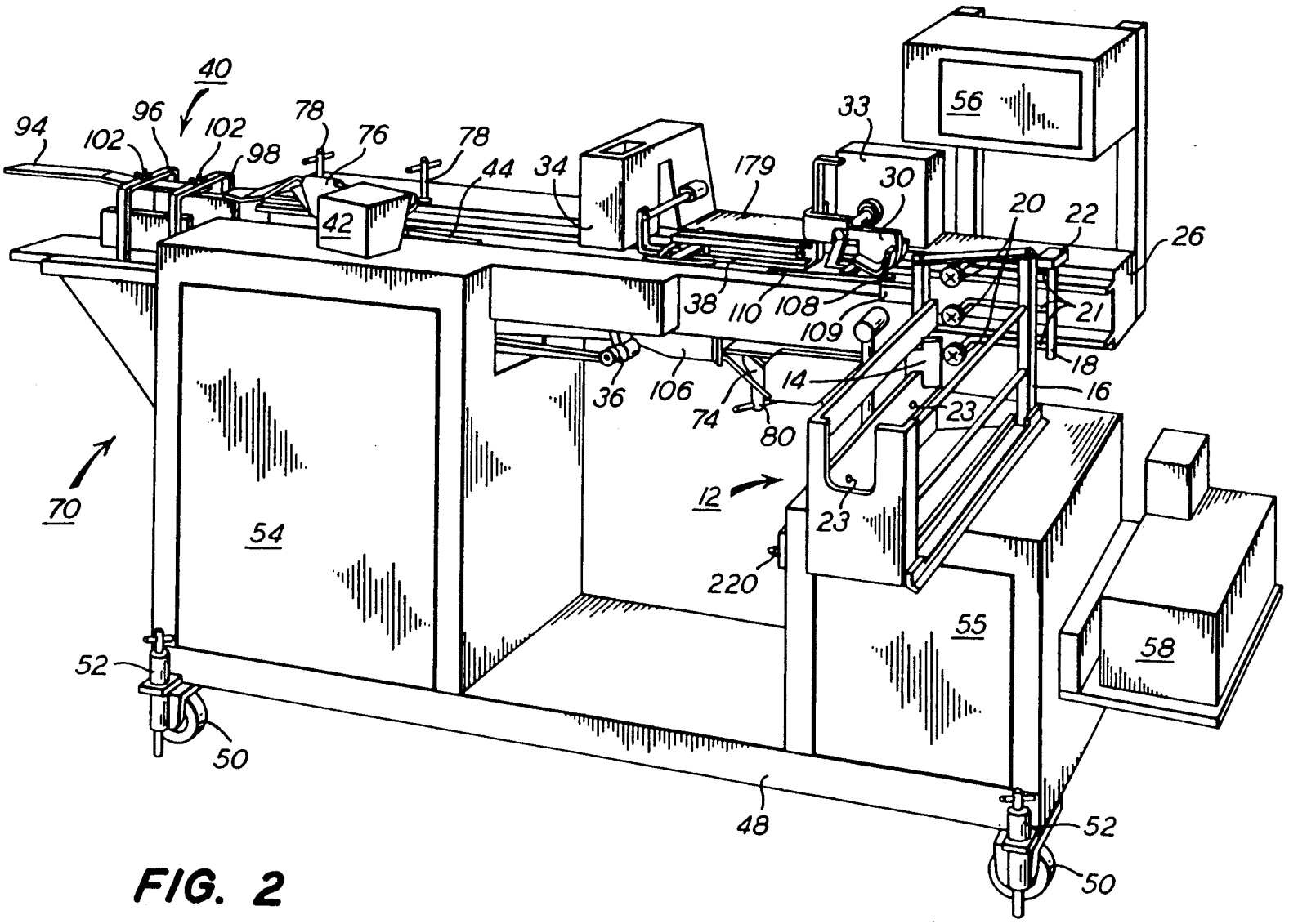
FIG. 2 is a perspective view of the ice cream carton filling machine of this invention showing the interchangeable components for assembling and filling lock end cartons installed on the base of FIG. 1.

An ice cream filling machine in accordance with this invention, set up in its lock end carton filling configuration is illustrated at FIG. 2. The machine 70 includes substantially all of the elements shown and described in connection with FIG. 1, and also includes the set of interchangeable components shown in FIGS. 3–8, for filling and closing lock end cartons.

Figure 7:
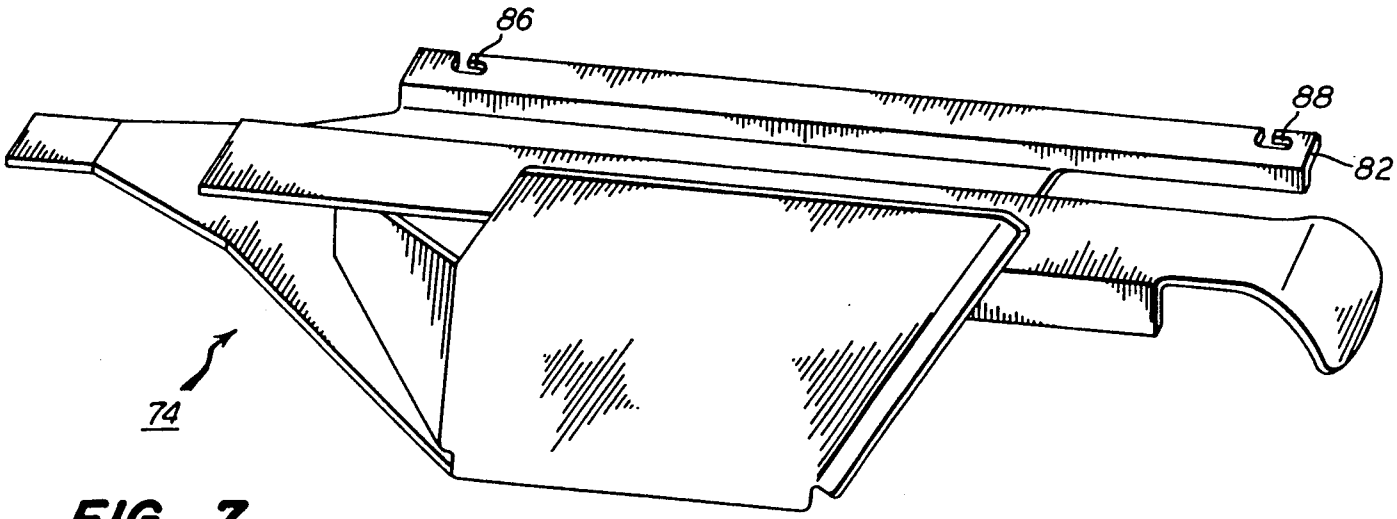
Figure 8:
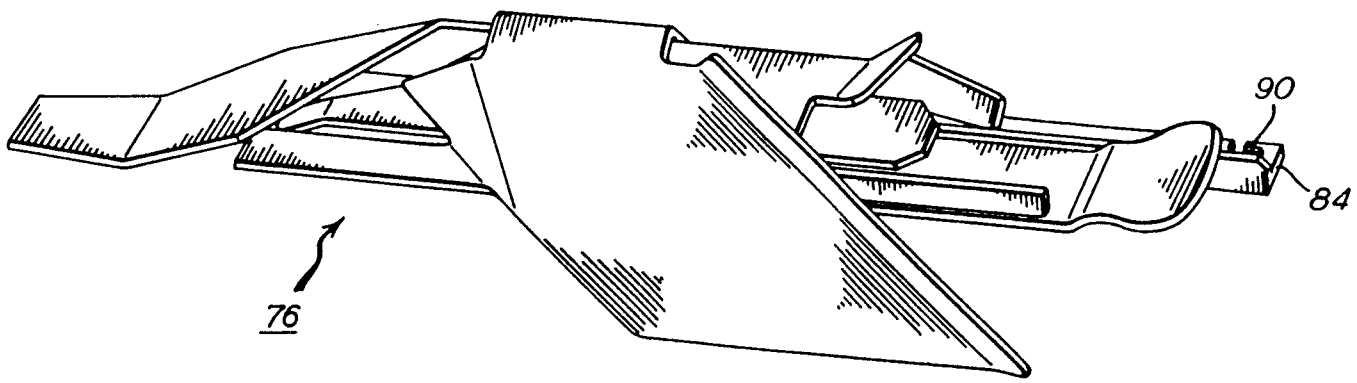

It will be appreciated that in the lock end carton filling configuration shown in FIG. 2, the ice cream filling machine of this invention substantially duplicates the function of known ice cream filling machines for filling lock end cartons. However, the present machine does so while using one of two or more sets of interchangeable components specially modified to be removably and interchangeably mounted on the machine base 10 to fill lock end cartons. The present machine, fills lock end cartons in a more efficient manner than the 555 machine mentioned above, by eliminating three assembly stations or carton positions used on the 555 machine, to both simplify the operation of the machine render it more reliable, and make it adaptable to the interchangeable configurations of the present machine. The physically largest of the interchangeable components are the lower and upper flap tuck ploughs shown in FIGS. 7 and 8 respectively, and indicated in FIG. 2 as ploughs 74 (bottom) and 76 (top). The upper plough 76 is attached to the rear half of the conveyor assembly by T-handles 78, while the lower plough 74 is attached to the underside of the front conveyor half by two T-handles 80, of which only one is visible in FIG. 2. The ploughs as shown in FIGS. 7 and 8 are known per se and operate in a known manner. In accordance with this invention, they are adapted for interchangeable installation by providing mounting rails 82 and 84 respectively, with L-shaped mounting grooves 86 and 88 on plough 78 and 90 and an obscured groove on plough 76. The L-shaped mounting grooves allow the plough assemblies to be installed and removed without completely removing the T-handle fasteners, and additionally to be adjusted longitudinally with respect to the path of the cartons, as required. The particular manner in which the ploughs fold and lock the flaps of a lock end carton is known and $\rho\epsilon\theta\sigma\epsilon$ forms no part of the present invention, and accordingly will not be described in further detail.

In addition to the ploughs, a carton exit guide 94 (see FIG. 5) is attached to U-shaped support brackets 96 and 98 by threaded studs 100 attached to the carton guide and wing nuts 102, as shown in FIG. 2. The exit guide 94 assists in squaring off the filled lock end cartons and delivering them from the machine at exit station 40.

Figure 4:
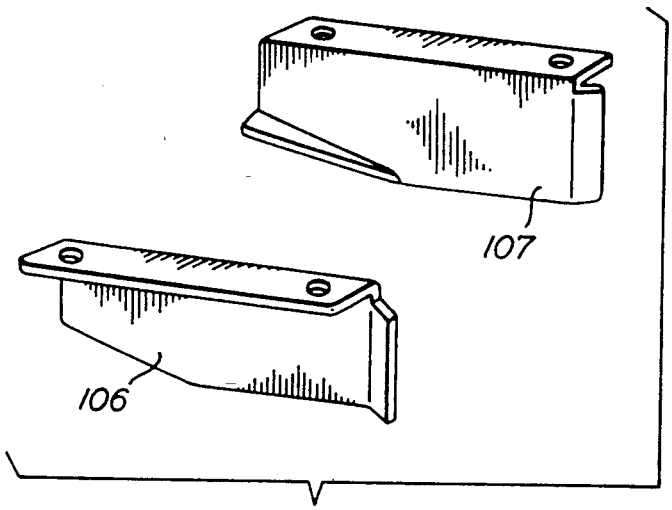
Figure 5:
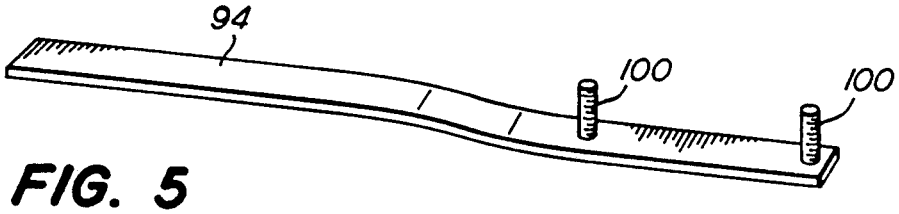
Figure 6:
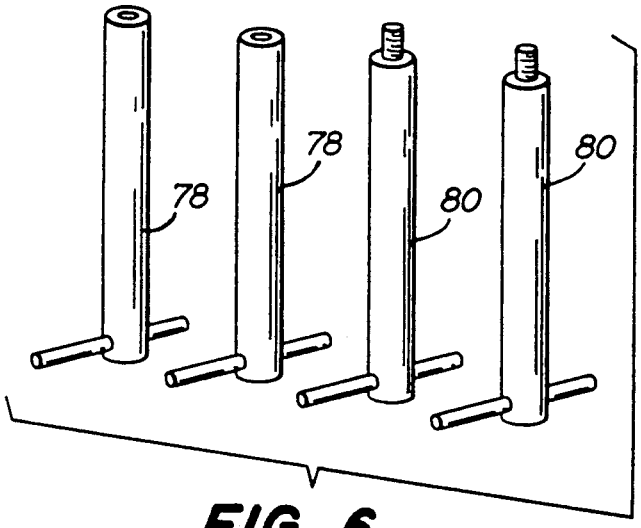

As shown in FIGS. 2 and 4, left and right bottom carton ploughs 106 and 107 (only 106 is visible in FIG. 2) respectively are attached to the underside of left and right conveyor tracks respectively, to raise the empty cartons into engagement with lower portion 34 of nozzle 32, for filling.

Interchangeable flap guide rail 108 is attached to the machine base 10 by a mounting bracket 109 just ahead of ding dong 30. The rod portion 110 of the flap guide extends in overlapping relation and slightly beyond the range of travel of ding dong 30 to hold the second down flap open until the carton reaches and the carton can be guided by guide rail 38.

The carton filling machine just described, as illustrated in FIG. 2, and having the interchangeable components shown in FIGS. 3 through 8 mounted thereon, is set up for filling lock end cartons.

Referring now to FIG. 17 and the components shown in FIGS. 9 through 14 and 19–20, the configuration of the machine for filling glued end cartons will be described. It will be immediately appreciated that only a relatively small number of components of the machine of FIG. 2 must be removed and replaced with the components shown in FIGS. 9 through 14, 19 and 20, to convert the lock end carton filling machine to a glued end carton filling machine. This is an important advantage in small volume applications, since only a single machine may be available, and the time required to switch from one form of carton to the other may represent a substantial loss in production capacity, and therefore in income. The dual purpose ice cream filling machine of this invention may be routinely converted from one configuration to the other in one half hour or less, with the use of no more than common hand tools.

Referring now to FIG. 21, and FIGS. 9 through 14, 19 and 20 the glued end carton configuration of an ice cream carton filling machine in accordance with this invention is illustrated. Beginning at the delivery end of the machine, the glued end configuration utilizes a delivery top guide rail 120, that includes a preferably rectangular metal pressure plate 122, for exerting downward pressure on the top end of the freshly glued carton for setting the glue. The plate mounts to U-shaped supporting brackets 96 and 98, with threaded studs 126 and 128 and wing nuts 102, as described above. The guide rail-plate structure is shown in detail in FIG. 9.

Referring now to FIG. 10, a supplemental hopper guide rail 130 has threaded studs installed in mounting holes 23 along one side of supply hopper 12, as shown in FIG. 21, for smoothly guiding the flattened glued end cartons through the hopper to the delivery point.

Figure 3:
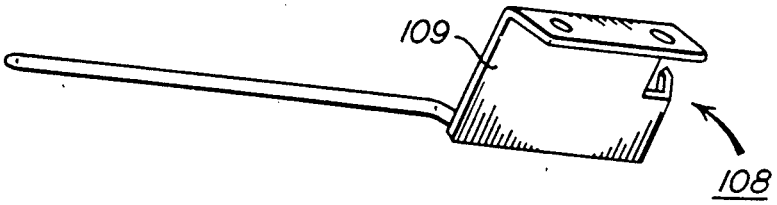
FIGS. 3 through 8 are perspective views of the interchangeable components that are mounted on the ice cream machine base of FIG. 1, to form the lock end filling machine shown in FIG. 2.

Flap guide rail 108, as shown in FIG. 3, is replaced with guide rail 136 as shown in FIG. 12, which is attached to the machine base by mounting bracket 137. Lower flap tucker and guide rail assembly 140 is installed on the underside of conveyor 26, but is not visible in FIG. 17.

The fasteners 142 and 144 shown in FIG. 13 are used to attach the lower glue gun assembly to the base while the T-handle fasteners 146 and 148 shown in FIG. 14 are used to mount the upper glue gun assembly.

Figure 19:
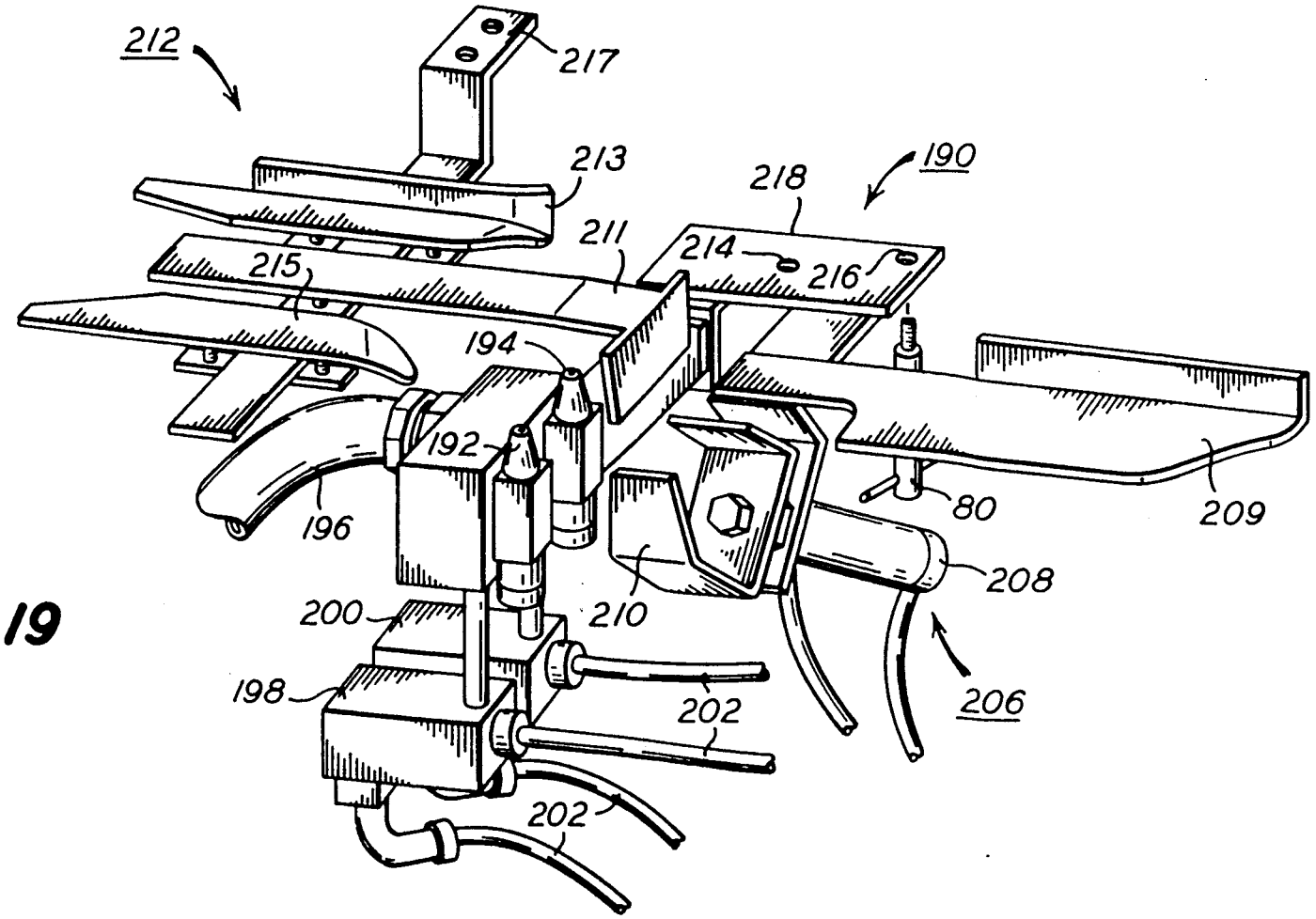
FIG. 19 is a perspective view of the lower hot melt glue gun assembly and related components for closing the bottom of a glued end carton in accordance with this invention.
Figure 20:
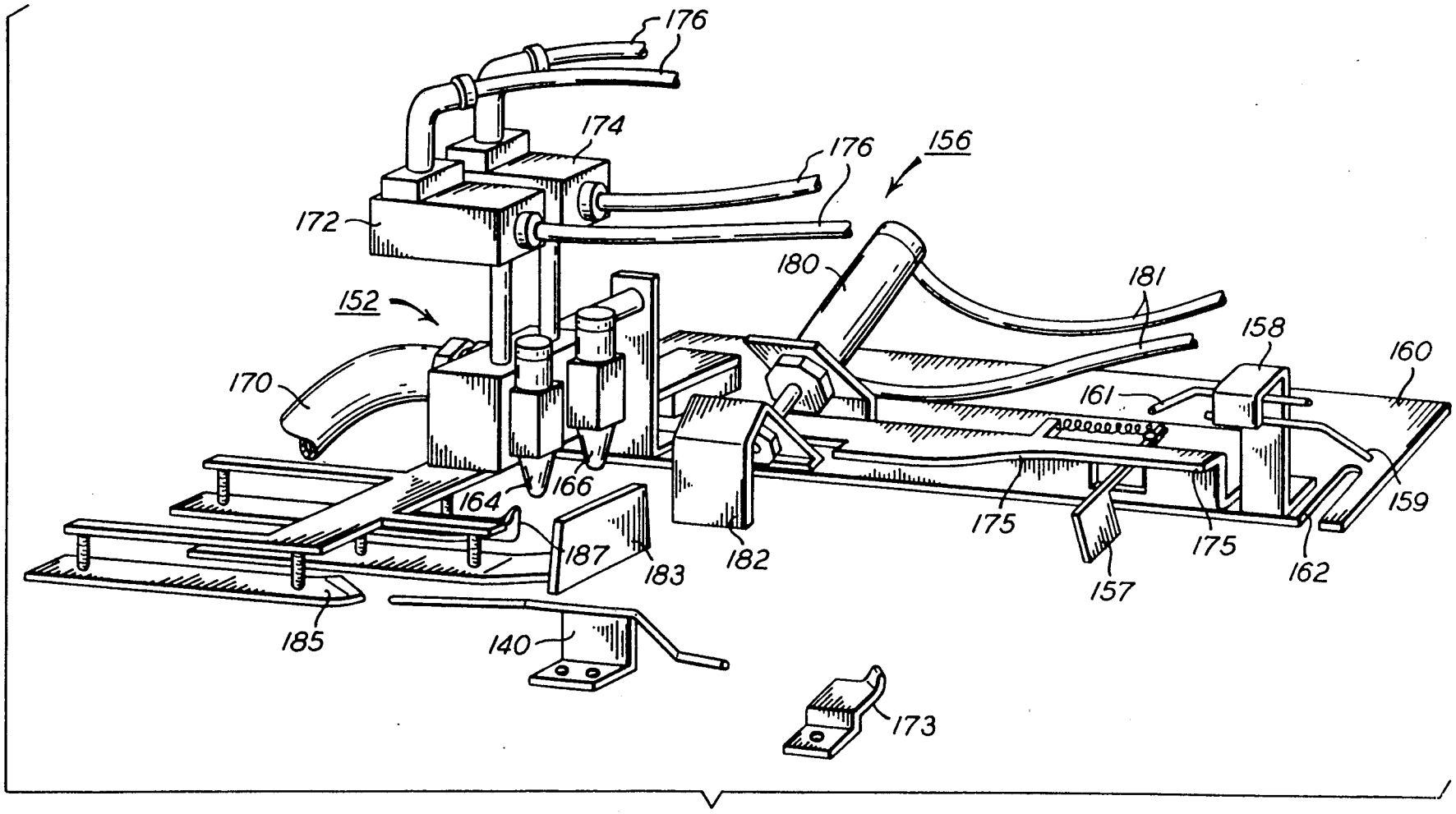
FIG. 20 is a perspective view of the upper hot melt glue gun assembly and related components for closing the top end of a glued end ice cream carton in accordance with this invention.

All that remains to complete the conversion is the removal and replacement of the upper and lower flap tucking ploughs 74 and 76, with the upper and lower hot glue gun assemblies 150 and 190 shown in FIGS. 19 and 20. The upper hot glue assembly 150 shown in FIG. 20 includes a pneumatically controlled two jet glue head 152 attached to a common support base 160 with a pneumatic flap tucker 156 and a dual guide rail assembly 158 having an inner guide 159 and an outer guide 161. Each of these guides is attached to mounting plate 160, which is provided with a pair of mounting slots 162 (only one of which is visible) for mounting the assembly in the same position on the machine base as the upper flap tucking plough of the lock end configuration. The glue head assembly 152 includes two jets or nozzles 164 and 166 fed by a common hot melt glue supply line 170 that is attached to hot melt glue supply unit 58 by an extension of line 170 that is omitted from the drawing for clarity. The hot melt glue supply unit itself is conventional. The glue jets are independently controlled by pneumatically operated control valves 172 and 174, which are attached to a conventional sequencer and controller within cabinet 55 by air lines 176 for activating the pneumatic controllers and ejecting a measured amount of glue from each of glue nozzles 164 and 166, as the ice cream carton moves under the hot melt glue unit 152. Pneumatic flap tucker 156 includes a pneumatic cylinder 180, coupled to a generally V-shaped tucker arm 182, that engages the second down flap in a manner that will be more fully described below. Preferably the pneumatic control lines 176 for the glue guns and the flap tucker 156 are connected to the controller by quick disconnect fittings 220 (FIG. 21) mounted through the side wall of cabinet 55.

Referring now to FIG. 19, the lower hot melt glue assembly 190 is similar to the upper hot melt glue assembly. The assembly 190 is adapted to be mounted in substantially the same location as the lower lock end plough 74. The hot melt glue portion of the assembly includes first and second upwardly facing glue jets 192 and 194, supplied by a common hot melt glue supply line 196. First and second pneumatic actuators 198 and 200 are coupled to the glued jets 192 and 194 respectively. The actuators are controlled by a controller and sequencer to which they are connected by pneumatic lines 202. The hot melt glue supply line and pneumatic control lines are connected to glue supply unit 58 and to the controller as described for the upper glue unit 152.

A lower pneumatic flap tucker 206 includes a pneumatic cylinder 208, and an extensible/retractable pneumatically controlled plough 210, for tucking in the second down flap of the carton bottom, prior to the carton reaching the glue station. Preferably, the entire assembly is attached to the underside of the machine by T-fasteners 80, which engage openings 214 and 216 in a plate 218.

Referring now to FIG. 15, the front end of the top glue gun assembly is shown as mounted on the machine base to illustrate its relationship with various other elements of the ice cream carton filling machine in the glued end configuration.

Guide rails 159 and 161 control the upper second down flap as the carton moves from right to left, while the upper first down flap is being pushed into the closed position by flap tucker 44. Upper first down flap lifter 163 is pivotally mounted on a post 165, and is biased into position for engaging the upper first down flap by spring 167, which is connected between one end 169 of the lifter and a fixed post 171. The first down flap lifter 163 is a common element to both the glued end carton filling configuration, and the lock end carton filler configuration of the machine, in accordance with this invention, and is not removed during changeover.

A flap plough 173 mounted on the machine base underneath flap tucker 44 holds the fourth down flap in an extreme open position, so that flap tucker 44 can pass over the fourth down flap and engage the outer surface of the first down flap to push the first down flap to the closed position, without interference from the fourth down flap. (See also FIG. 40.) Guide rail 175 guides the second down flap into a partially closed position, prior to passing under the pneumatic flap tucker 182, which pushes the second down flap to its fully closed position, as better seen in FIG. 20.

Referring now to FIG. 16, the upper carton guide rail assembly 179 is illustrated. The assembly is pivotally mounted on rod 181, which is attached to the base of the machine by swivel bearing block 183 (see FIG. 15). The swivel mounting permits the guide rail assembly 179 to be raised out of engagement with the carton path to remove damaged cartons or the like, or for routine servicing of the machine. The guide rail assembly 179 includes a lifting handle 184, and a positioning bracket 185, that rests on the operating shaft of the ding dong 32. Elongated plough 187 guides the third down flap to a fully open condition, and holds the first down flap in a fully open condition, in preparation for guiding the carton under the ice cream dispensing nozzle 34. Guide rods 189 and 191 guide the second and fourth down flaps respectively, to fully open positions, in preparation for passage to the filling nozzle. Pivotally mounted fork 193 is attached to lifting handle 184 at one end by a pivot 195, and includes first and second downwardly extending rods 197 and 199, that prebreak the third down flap to an extreme open position, in preparation for passing under the leading edge of the ice cream dispensing nozzle.

Referring now to FIG. 17, the lower flap tucker assembly is illustrated. A curved tucker arm 201 is pivotally mounted on a plate 203, that is attached to the ice cream machine base, by fixed arm 205. The tucker arm 201 is driven in conventional fashion by a cam within the base of the machine, which per se forms no part of the present invention. The leading edge 207 of the flap tucker arm 201 engages the bottom first down flap and pushes it to a partially closed position. The bottom flap tucker assembly functions identically for both lock end and glued containers.

Figure 18:
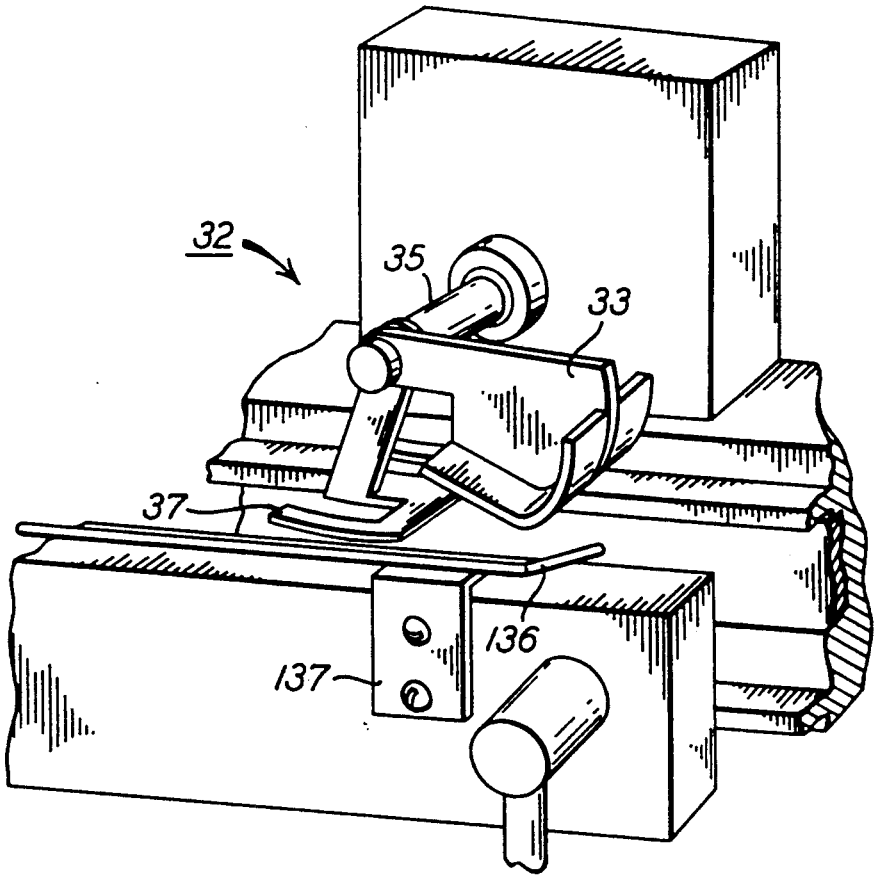
FIG. 18 is a fragmentary perspective view of the upper flap tucker assembly of an ice cream carton filling machine in accordance with this invention.

Referring now to FIG. 18, the upper flap tucker assembly or ding dong 32 is illustrated. Guide rail 136, which is also shown in FIG. 12 and FIG. 21, guides the fourth down flap to an open position and the extension of rod 36 holds the fourth down flap fully open. As the carton moves towards the flap tucker 32, the driven ding dong element 33 prebreaks the third down flap, as it rotates clockwise on actuator arm 35. The leading edge of the third down flap then passes under, and is held by trailing fork 37, which is spring loaded and driven in a clockwise direction by the ding dong, as it rotates clockwise. As the ding dong returns to its counter-clockwise position, as shown in FIG. 8, it prebreaks the first down flap, which then rides under the ding dong and the fork 37, as it moves to the next station.

The ding dong 32 is unchanged in converting the machine from the glued end to the lock end configuration in accordance with this invention, though the guide rail 136 and bracket 137 are replaced in the lock end configuration by bracket-guide rod combination 108, as shown in FIG. 3.

Referring now to FIG. 19, the lower glue gun assembly is shown. A leading edge of plough 209 guides the second down bottom flap into a partially closed position, where it can be fully closed by lower pneumatic flap tucker plough 210. Plough 209 is fixedly attached to plate 218, which mounts to the bottom of the ice cream machine frame. As the carton moves into the next position, plough 211 of the lower flap guide assembly 212 pushes the lower third down flap to a closed position, in preparation for the application of hot melt glue. As the carton moves over glue jets 192 and 194, several measured quantities of glue are applied to the first, second and third down flaps, in preparation for sealing. Side ploughs 213 and 215 guide the corner tab and fourth down flap respectively, to their fully closed positions, to contact the previously glued spots on the third down flap, and first and second down flaps respectively, to hold the flaps firmly in a closed position, and allow the glue to set.

The lower flap guide assembly 212 including the ploughs 211, 213 and 215 is mounted to the underside of the machine by bracket 217.

Figure 22:
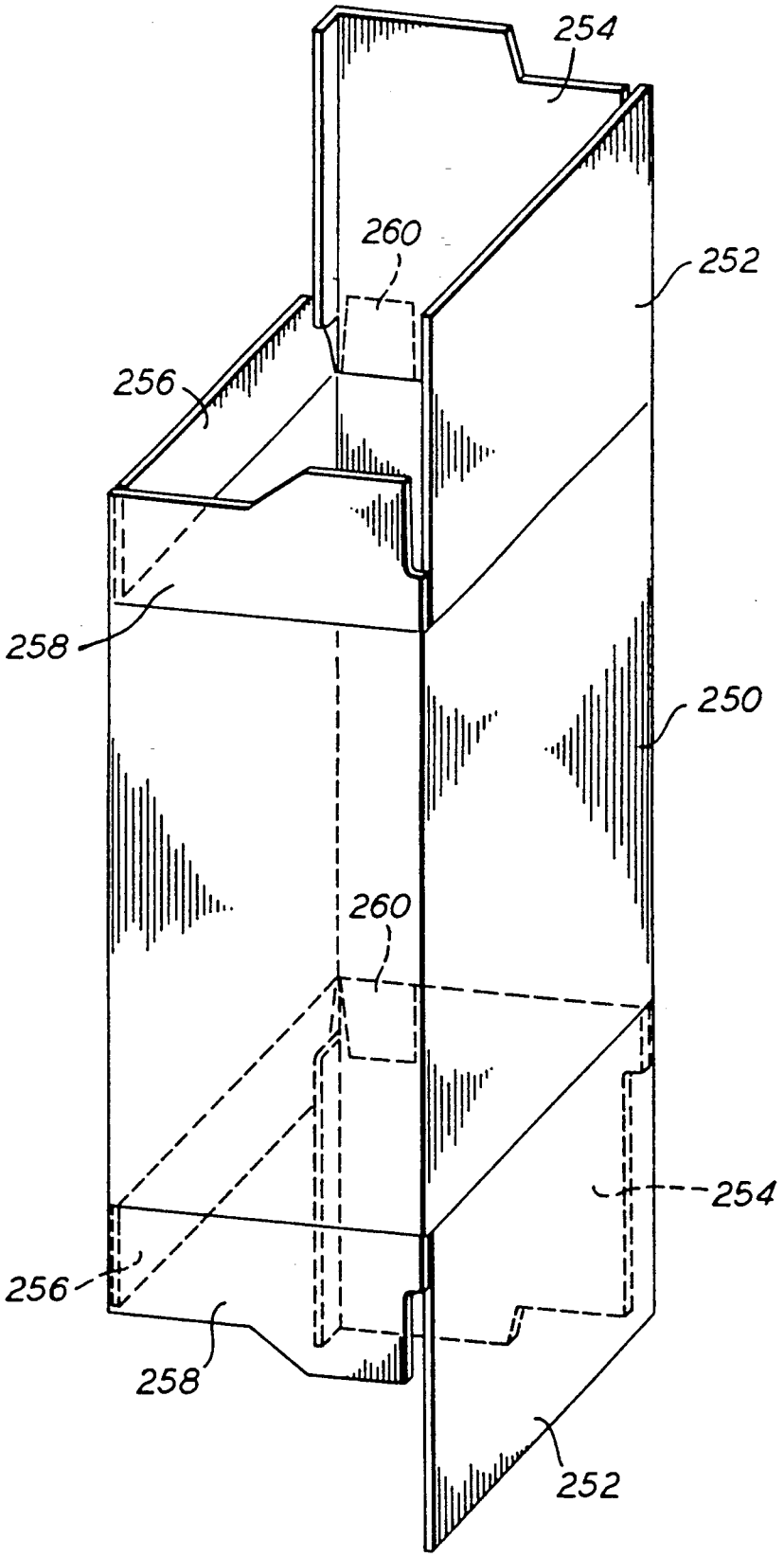
FIGS. 22 through 24 are perspective views of a glued end ice cream carton.

The operation of the ice cream carton filling machine of this invention in the glued end carton configuration may be more readily appreciated by following the path of a single carton from the hopper 12 to the exit station 40. Referring to FIG. 22, a glued end ice, cream carton is illustrated.

FIG. 22 shows a glued end carton in a partially erected condition, as it would appear as it is removed from the hopper. The carton includes a generally rectangular main body portion 250, and a plurality of flaps at each end, which are mirror images of each other. Each end includes a first down flap 252, a second down flap 254, a third down flap 256, and a fourth down flap 258. The corner tab 260 is obscured by the second down flap in each instance.

Figure 23:
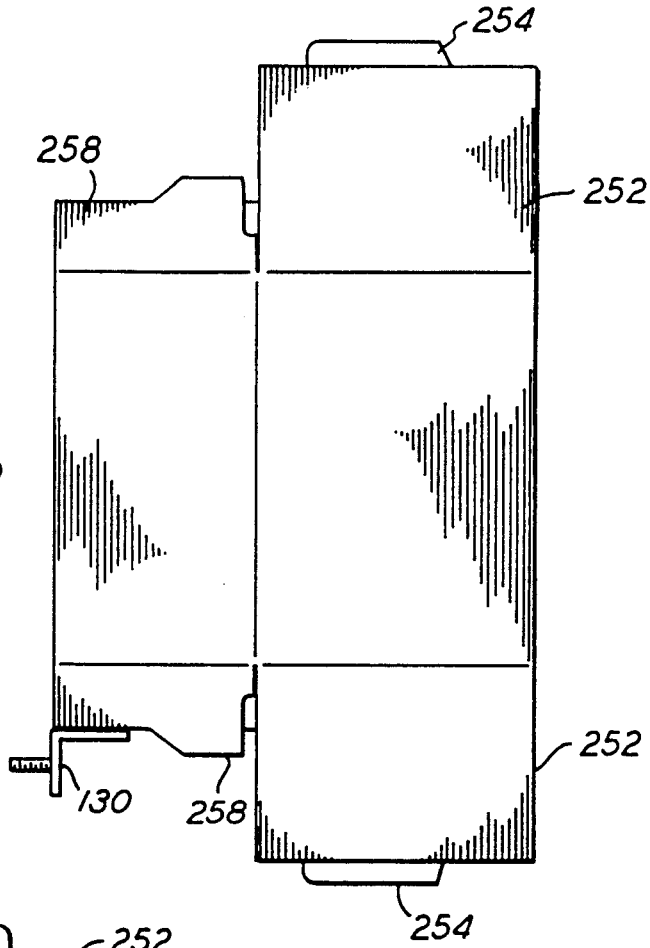
Figure 24:
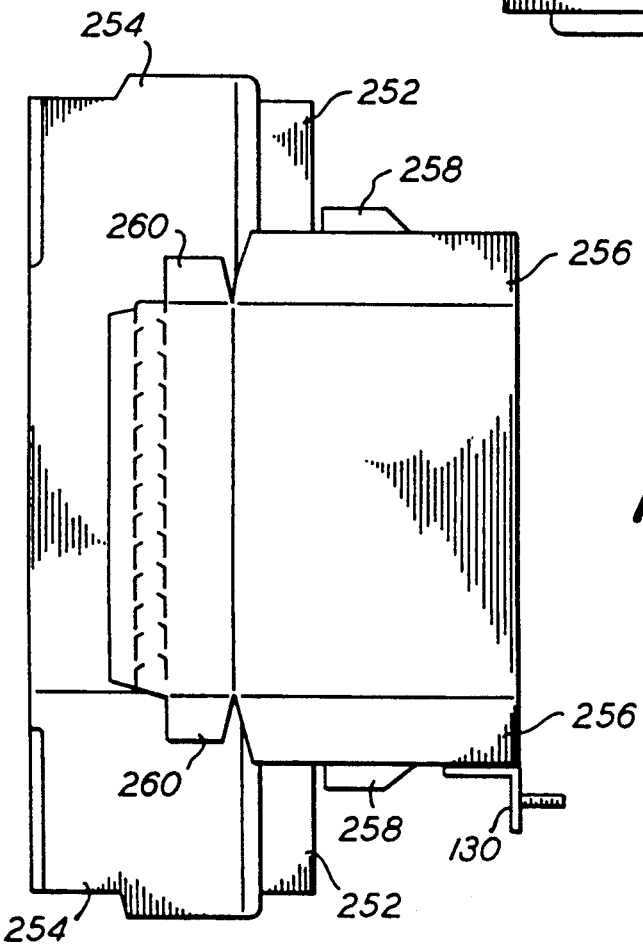

FIGS. 23 and 24 show the glued end carton in its flattened configuration, as stored in the hopper 12 For simplicity, only the auxiliary hopper guide rail 130 is shown.

With particular reference to FIG. 21 and FIGS. 25–48, the innermost carton in the stack of cartons in the hopper 12 is engaged by the resilient ends 20 of the three armed vacuum picker 18 to both pull the carton out of the hopper 12 and open the flattened carton into a generally rectangular configuration.

When the carton has moved into position on the conveyor, the vacuum releases and a squaring arm pushes the carton into the first station. As the carton moves to the first station, where the flap guide 136 first engages the top fourth down flap 258, and the elongated downstream extending portion of the first finger holds the second down flap open. The flap guide finger then catches the top first down flap 252 and pushes that flap back in the upstream direction in preparation for movement of the carton under the ding dong.

Figure 25:
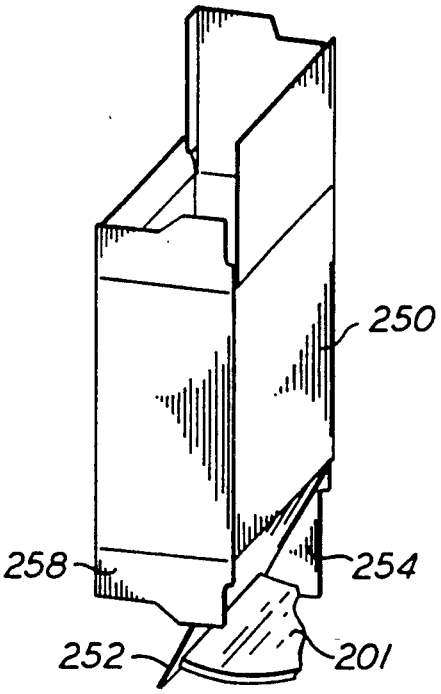

Simultaneously, the bottom of the carton is prepared for folding. The first down flap 252 is tucked into a partly closed position by a thin bottom flap tucker 201 as shown in FIG. 25. The second down flap 254 is folded up by plough 209, sufficiently far to hold the first down flap 252 and prevent it from opening (See FIG. 26). The carton is then ready to move from the first to the second station.

Figure 26:
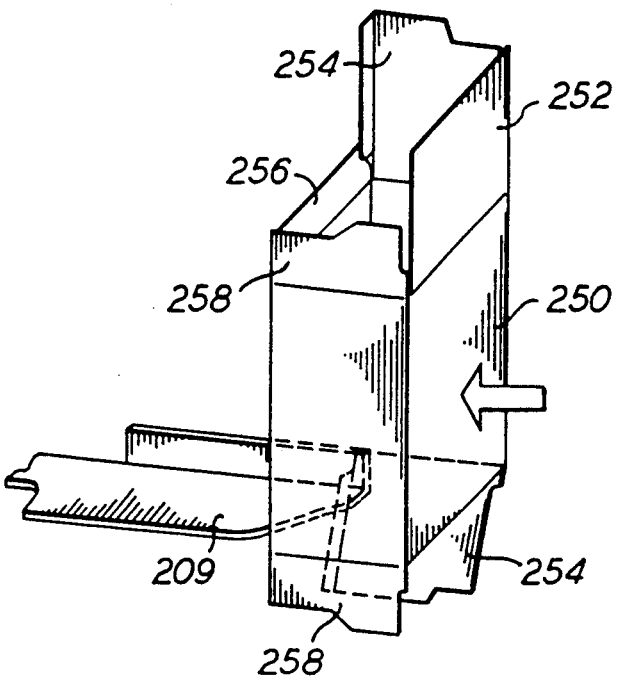
Figure 27:
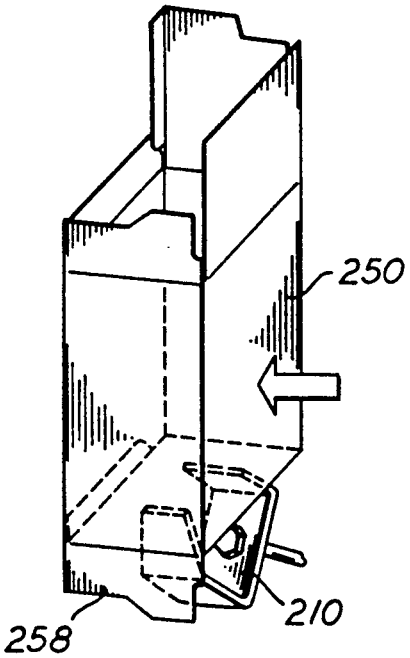
Figure 28:
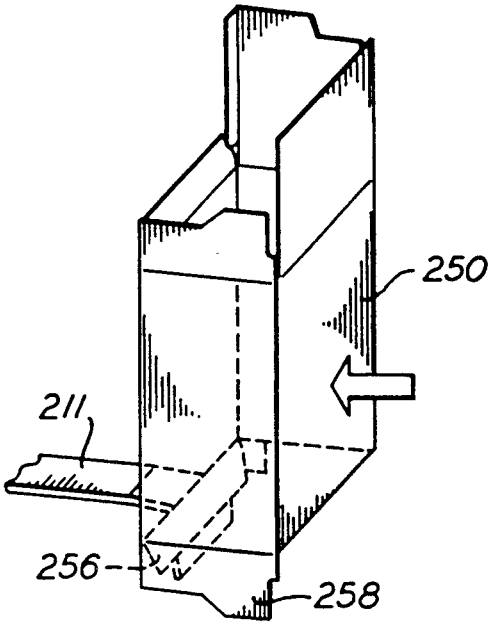
Figure 29:
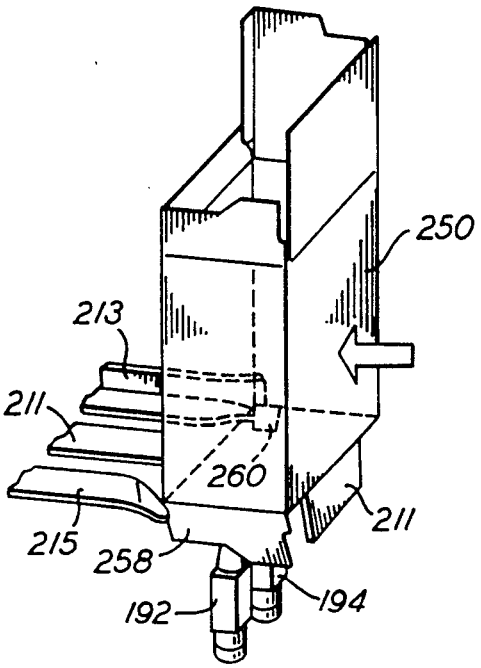
Figure 30:
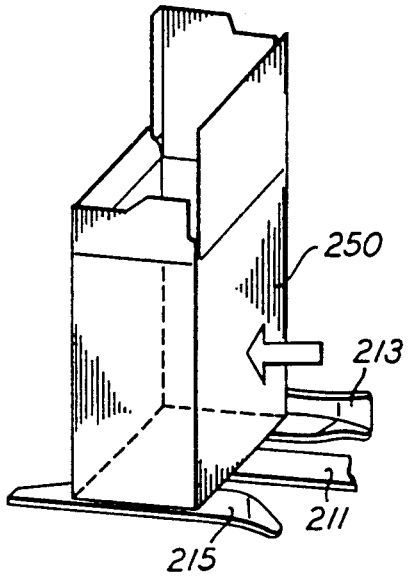
Figure 32:
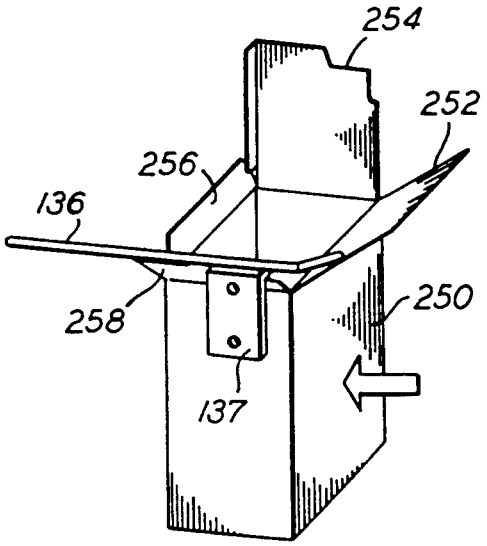
Figure 33:
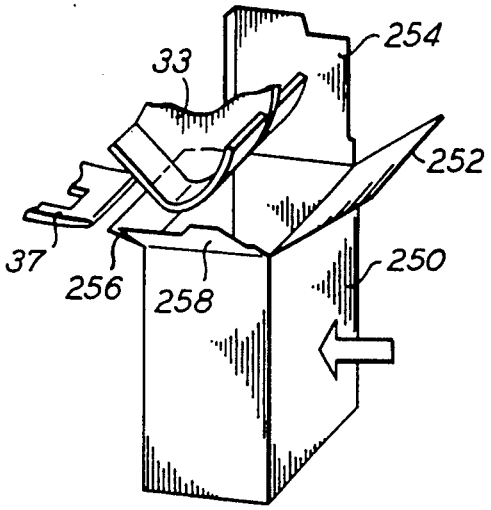
Figure 34:
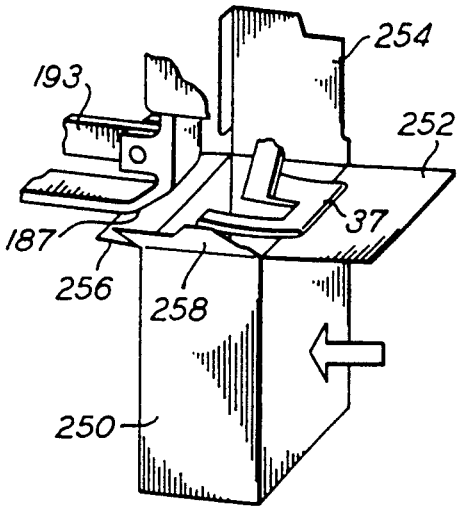

The upper ding dong 32 lays the top third down flap 256 forward, as shown in FIG. 33, and as the carton moves under the ding dong and the ding dong reciprocates, it pushes the first down flap back, where it is held by a flap holding shoe 37 as can be seen in FIG. 34. The fourth down flap continues to be held to one side by the guide rail 136 as shown in FIG. 32. During the transfer between station 1 and station 2, the second down bottom flap 254 is moved from a downwardly extending vertical position to a 45° position by the plough 209 as seen in FIG. 26, in preparation to being pushed up by the air cylinder flap tucker. The carton is then ready to move from the second to the third position. As the carton moves from the second to the third station, the lower pneumatic cylinder flap tucker 210 tucks up the bottom second down flap 254 fully as can be seen in FIG. 27. The third down flap is ploughed up and held by the plough and rail 211 in the center of the machine, as shown in FIG. 28. The carton then advances over the hot melt nozzles 192 and 194, as shown in FIG. 29. At this stage, the glue gun assembly deposits three dabs of glue on the second down flap 254, one under the corner tab 260 and two under the breakaway and stripe on the fourth down flap 258 of the bottom portion of the carton. The fourth down flap and corner tab are simultaneously ploughed up and sealed by the side ploughs 215 and 213 respectively, as shown in FIGS. 29 and 30. These flaps are held in position by the horizontally downstream extending horizontal portions of the ploughs. This completes the closing of the bottom of the carton. The bottom of the carton is sealed, and the carton is ready for filling. The carton is temporarily held at the third station to give the glue time to set to complete the sealing of the bottom portion of the carton. Pressure is applied to the last tab 260 and fourth down flap 256 by top surfaces of the two lower laterally spaced apart ploughs 213 and 215.

Figure 31:
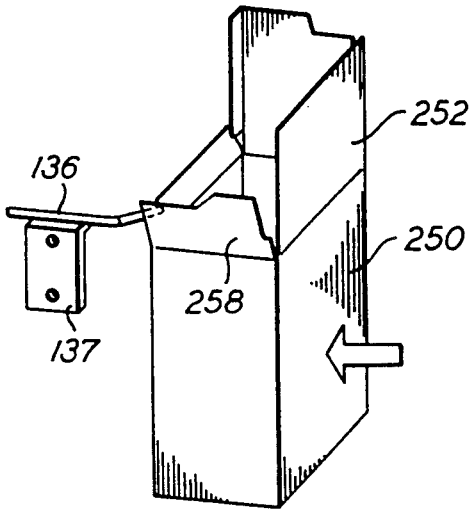
Figure 35:
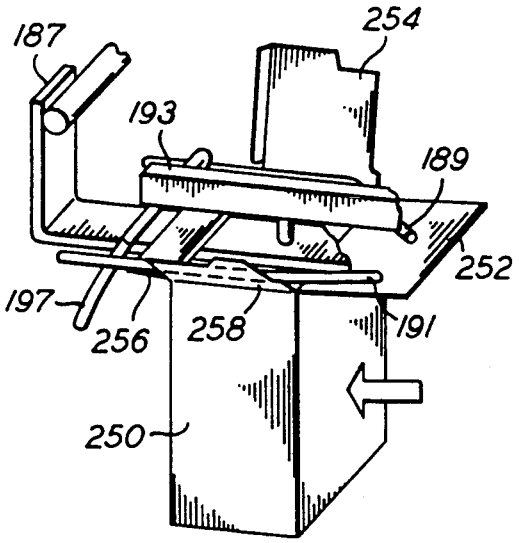
Figure 36:
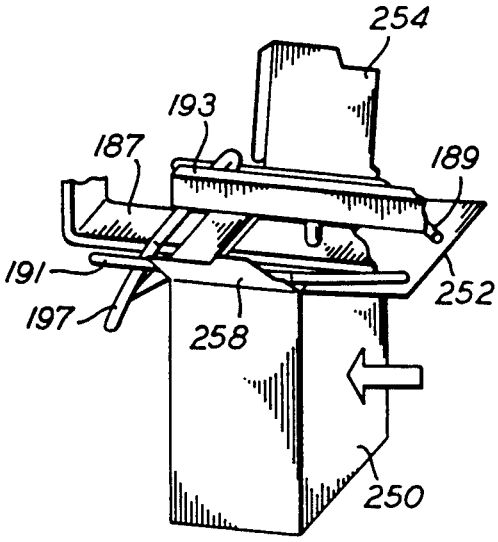
Figure 37:
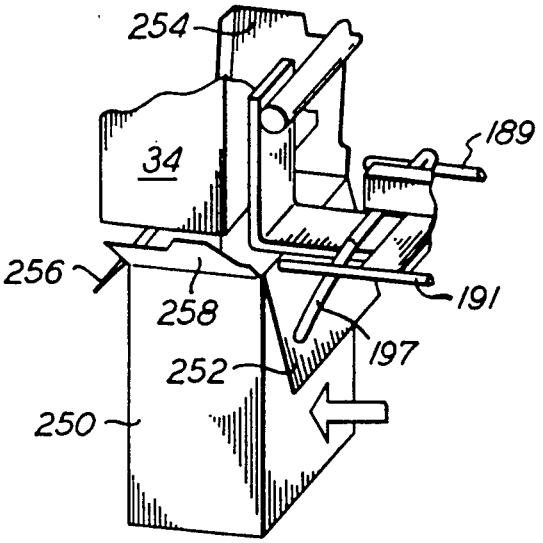
Figure 38:
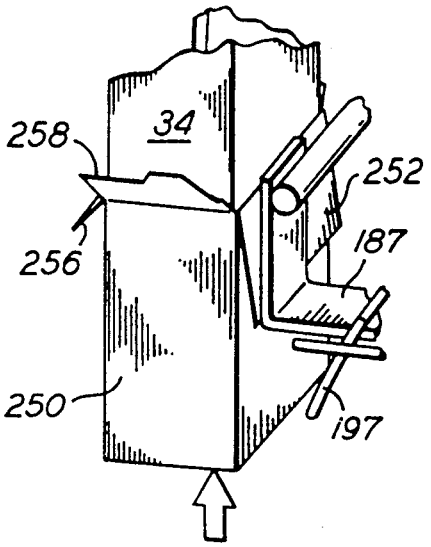

In moving to the filling station, the top guide rail 136 sequentially guides and then holds the fourth and first down flaps (258, 252) in a lateral and backward laid down position respectively, as shown in FIGS. 31 and 32. The upper guide rail assembly 179 holds the third and first down flaps 256, 252 in forward and backward laid open positions respectively as shown in FIG. 35. The fork 193 pushes down the top third down flap 256 to over-bend it to clear the lower end of ice cream filling nozzle 34, as the carton moves towards the nozzle, as shown in FIG. 36. This ensures that no ice cream will be deposited on the outside surface of the flap. The fork 193 also holds the first down flap 252 open as shown in FIG. 37. The carton is pushed up into overlapping engagement with the nozzle by the elevator arm 36, as shown in FIG. 38 and the carton is filled by the continuous flow of ice cream. As the carton moves upwardly and the ice cream dispensing spout enters the interior of the carton, first and second downwardly extending horizontally spaced apart fork fingers sharply bend the first down flap to an extreme open position adjacent the side of the carton. As the box approaches its predetermined weight, the weight of the ice cream in the box pushes down on elevator 36. The first down flap 252 is pushed tightly against the carton by the hooks 197 on the main tractor mechanism, so that as the trailing edge of the carton shears the ice cream from the filling nozzle, it protects the trailing surface of the carton. At this stage the cartons are closely adjacent, so that no ice cream is ejected between the cartons.

When the carton is full, a position sensitive switch is tripped to indicate that a cycle has been completed, and to initiate the next cycle. Thus, the machine continually cycles in a synchronous fashion to repeatedly fill cartons as they are brought into registration with the filling nozzle.

Figure 39:
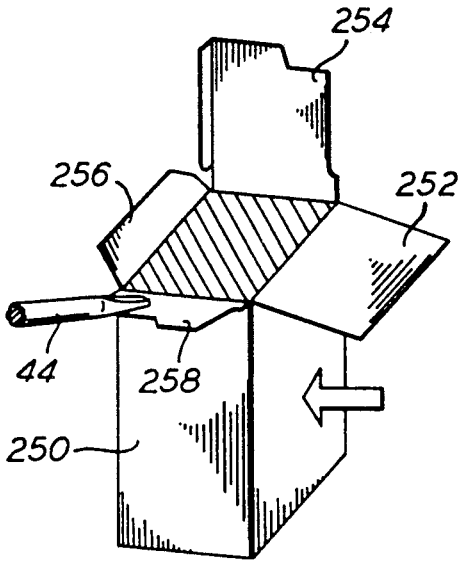
Figure 40:
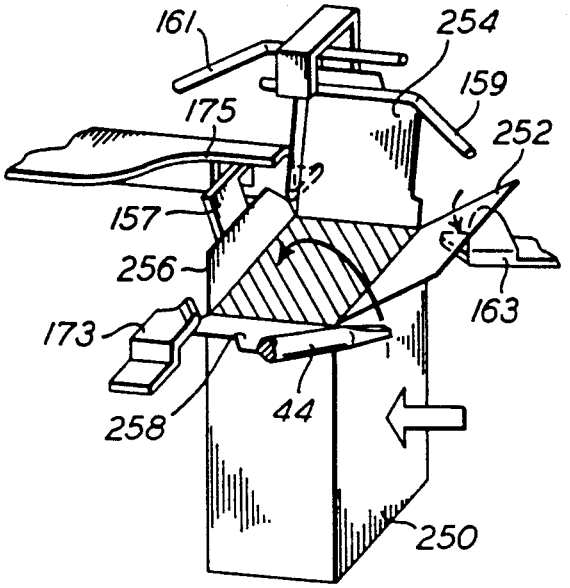
Figure 41:
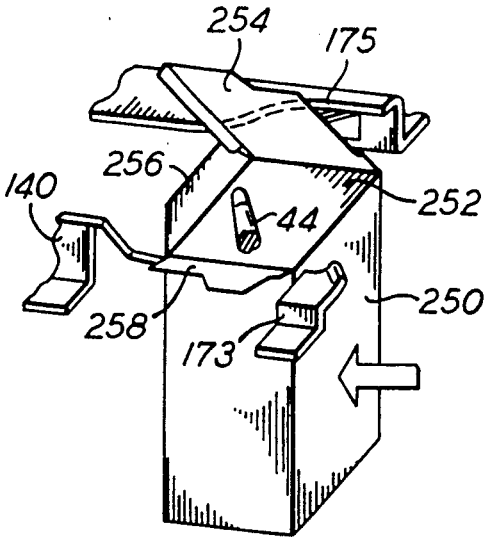
Figure 42:
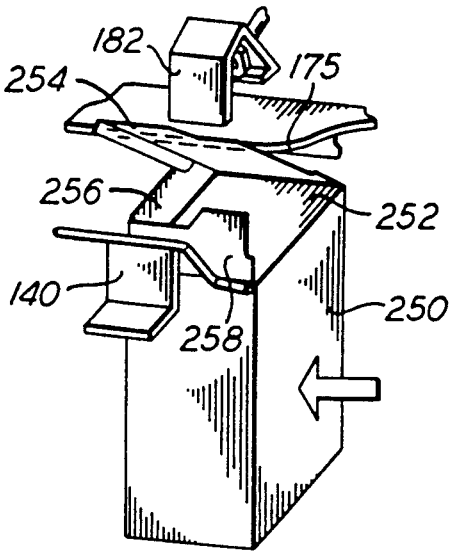
Figure 43:
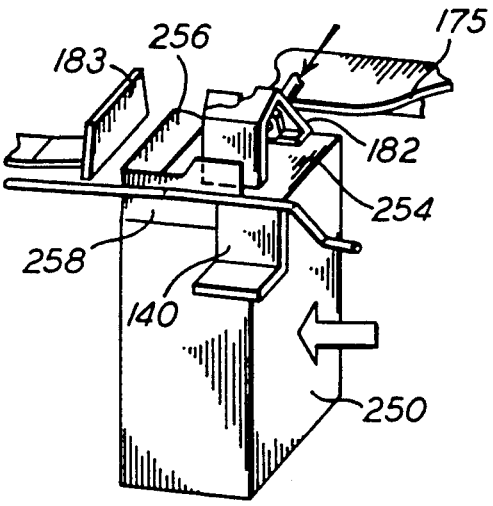
Figure 44:
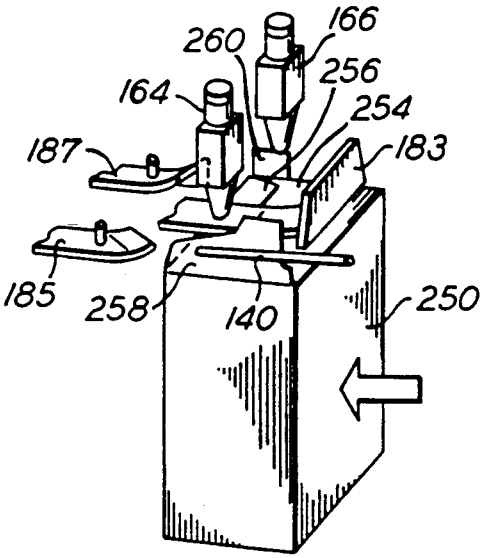

The filled carton then moves from the fourth to fifth station, as shown in FIGS. 39 and 40. The second down flap is guided between the inner and outer guide rails 159 and 161 of the assembly 158 to hold it open in preparation for moving the first down flap to the closed position. The flap raiser 44 holds 4th down flap 258 fully open to guide it under flap retaining plough 173.

The distal end of the flap raiser 44 also engages the inside surface of the first down flap, and holds it in the open position. As the carton moves past the spring flap lifter plough 163, the first down flap 252 disengages from the wand and the flap lifter 163 moves suddenly under the first down flap 252 to kick it to an approximately 45° angle, in preparation for closing as shown in FIG. 40. The end of the flap raiser 44 is then under the flap 252 and as the wand 44 returns to its normal position, it closes the first down flap. As the first down flap 252 is fully closed, the spring loaded stop mechanism 157 moves the leading third down flap 256 into a position engaging the second down flap 254 to hold the first down flap 252 closed. The rear, side-plough 175 then pushes the second down flap to a partially closed position, securing the first down flap. Shortly thereafter, the guide rail 140 on the front edge of the machine engages the fourth down flap, and begins to move it to the closed position. Previously, this flap was maintained in a fully open position by the broad horizontal downstream extending portion of plough 173.

Figure 45:
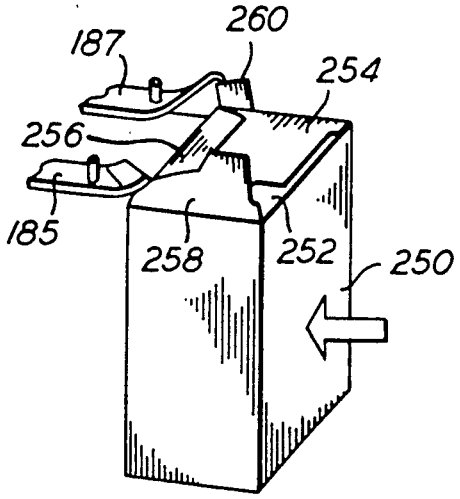
Figure 46:
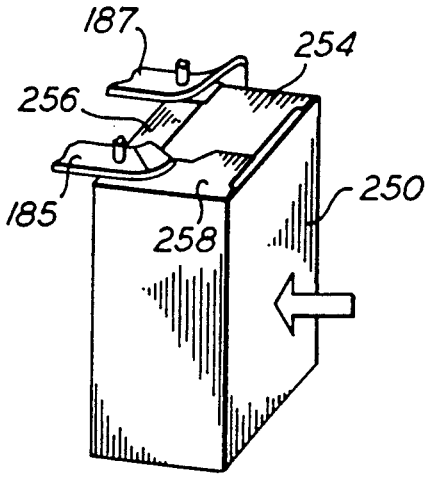
Figure 47:
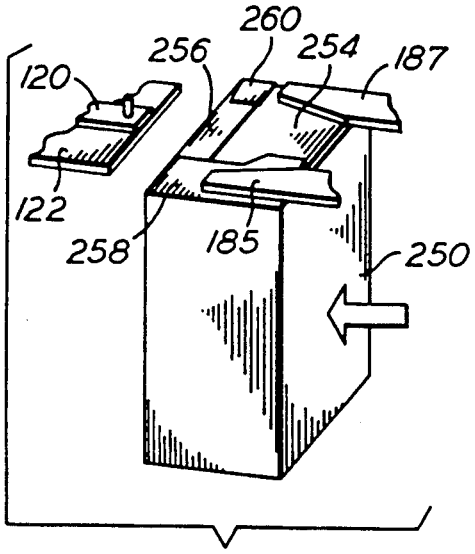
Figure 48:
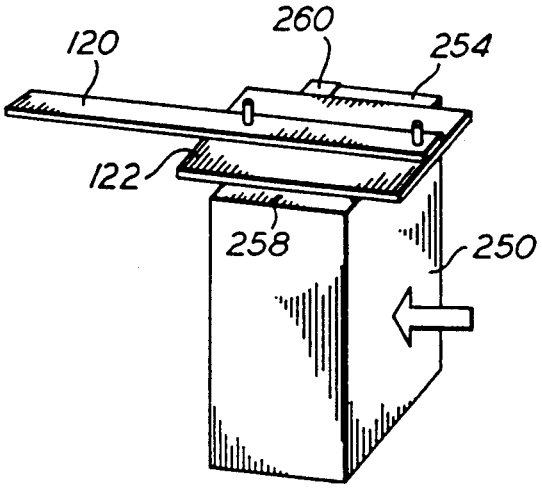

As the carton moves to the next station, the fourth down flap 256 has been moved to a vertical position, and the second down flap 254 has been bent to an almost closed position by the plough 175. Plough 175 prepositions second down flap 254 for the pneumatic flap tucker 182. The carton is then in position to have its top sealed. The pneumatic flap tucker 182 pushes down the second down flap 254 to hold the first down flap 252. As the carton moves forward, (see FIG. 43) the plough 183 pushes down the third down flap 256 into position to hold the second down flap. As the carton moves under the upper glue assembly, two dabs of glue are applied to the third down flap, one under tab 260, and one under the fourth down flap 258. A third dab of glue is applied to the second down flap under the fourth down flap. The glue is applied in elongated lines, as the carton moves under the glue guns. The length of the lines is determined by the time during which the glue guns are energized. After the glue has been applied, ploughs 185 and 187 close fourth down flap 258 and tab 260 respectively, onto the previously glued areas of the first and third down flaps, and the elongated horizontal extensions of the ploughs hold the fourth down flap and tab in position as the glue sets, as shown in FIGS. 45 through 47. The carton then moves to the exit station, where the top is held briefly in compression by plate 122, to allow the glue to set, as shown in FIG. 48.

The ease by which the ice cream filling machine of the present invention may be converted from the lock end filling configuration to the tamper evident glued end configuration may be more readily appreciated by the following description of the steps necessary to make the conversion. The present invention minimizes the number of parts that must be exchanged.

First, T-bolts 78 holding the top flap tucking plough 76 are loosened and the plough is removed. The upper hot melt glue unit 150 is moved from a storage position immediately behind the plough into an operating position and secured with the two T-bolts.

Similarly, the bottom flap tucking plough 74 is removed by removing T-bolts 80. The lower flap tucker assembly and hot melt glue unit 190 and the pressure guide rail unit, and limit switches are then installed. The lower hot melt unit 190 is mounted by T-bolts 210 and 212. The pneumatic control lines 176 and 202 are connected to quick connect fittings 220 in control cabinet 56. The top flap guide rail 108 is replaced by flap guide ail 136, and the delivery guide rail 94 is removed and replaced by guide rail 120. Lower carton guides 106 and 107 are removed and stored. Auxiliary guide rail 130 is installed in hopper 12, and the changeover is completed. Preferably, one or more shields (not shown) is installed as desired. The entire conversion can be accomplished rapidly and easily.

While the invention has been described in connection with the presently preferred embodiment thereof, certain modifications and changes will no doubt suggest themselves to those skilled in the art, without departing from the true spirit and scope of the invention, which accordingly is intended to be defined solely by the appended claims.

What is claimed is:

1. A versatile ice cream carton filling machine comprising:

hopper means for storing a plurality of empty cartons;

filling means for filling the empty cartons with ice cream;

transport means for moving the empty cartons from the hopper means to the filling means and for moving the filled cartons away from the filling means to a discharge station;

interchangeable carton closing means mountable on the machine comprising:

removable bottom flap tucking means disposable between the hopper means and the filling means for closing one end of a lock end carton;

removable top flap tucking means disposable between the filling means and the discharge station for closing the top of a lock end carton;

top adhesive sealing and closing means interchangeably disposable with said top flap tucking means between the filling means and the discharge for closing the top end of a tamper evident glued end carton;

bottom adhesive sealing and closing means interchangeably disposable with the bottom flap tucking means between the hopper means and the filling means for closing the bottom end of a tamper evident glued end carton; and attachment means on said machine for interchangeably receiving said adhesive sealing means and flap tucking means.

2. The ice cream carton filling machine of claim 1 further comprising interchangeable flap guide rail means mounted adjacent the transport means for engaging a flap of a lock end ice cream carton, and flap guide rail means for engaging a flap of a glued end carton.

3. The ice cream carton filling machine of claim 1 further comprising removable glued end carton support means mountable in said hopper means for feeding glued end cartons, and removable from said hopper means for feeding lock end cartons, and attachment means in said hopper for receiving the support means.

4. The versatile ice cream carton filling machine of claim 1 in which the bottom adhesive and closing means comprises first and second glue jets, and means connected to the glue jets for removably mounting the glue jets on the ice cream carton filling machine.

5. The ice cream carton filling machine of claim 4 in which the bottom adhesive sealing and closing means further comprises the lower pneumatic flap tucking means mounted upstream of the glue jets for engaging and closing a bottom second down flap of a glued end ice cream carton.

6. The ice cream carton filling machine of claim 5 further comprising plough means disposed upstream from said pneumatic flap tucker means for prepositioning a second down flap of an ice cream carton to a partially closed position for engagement by said flap tucker means.

7. The ice cream carton filling machine of claim 1, in which the top adhesive sealing and closing means comprises upper glue jet means removably attachable to the machine in a position spaced above the path of the ice cream cartons.

8. The ice cream carton filling machine of claim 7 further comprising upper pneumatic flap tucker means disposed upstream from said upper glue jet means for engaging and closing a top second down flap of the glued end ice cream carton.

9. The ice cream carton filling machine of claim 8 further comprising upper plough means disposed upstream from said upper pneumatic flap tucker means for engaging and prepositioning a second down flap of a glued end ice cream carton in preparation for closing by the upper pneumatic flap tucker means.

10. The ice cream carton filling machine of claim 9 further comprising upper flap guide rail means for engaging a top second down flap of a glued end ice cream carton filling machine, and disposed upstream from said plough means.

11. The ice cream carton filling machine of claim 10, further comprising common mounting means attached to said upper flap guide rail means, said upper plough means, and said upper pneumatic flap tucker means.

12. The ice cream carton filling machine of claim 11, in which said common mounting means also comprises means for mounting said upper glue jet means.

13. The ice cream carton filling machine of claim 1 in which the discharge station comprises removable delivery guide rail means removably mounted on said ice cream carton filling machine, for tamper evident glued end carton sealing only.

* * * * *